United States Patent [19]

Minakuchi

[11] Patent Number: 4,559,488

[45] Date of Patent: Dec. 17, 1985

[54] INTEGRATED PRECISION REFERENCE SOURCE

[75] Inventor: Hiroshi Minakuchi, Shiga, Japan

[73] Assignee: Matsushita Electric Industrial Co., Ltd., Osaka, Japan

[21] Appl. No.: 555,678

[22] Filed: Nov. 28, 1983

[30] Foreign Application Priority Data

Dec. 3, 1982 [JP] Japan ..... 57-212912

[51] Int. Cl.[4] ..... G05F 3/20

[52] U.S. Cl. ..... 323/281; 323/314

[58] Field of Search ..... 323/280, 281, 311–316

[56] References Cited

U.S. PATENT DOCUMENTS 3,617,859 11/1971 Dobkin et al. ..... 323/313 X 3,887,863 6/1975 Brokaw ..... 323/316 X 4,260,946 4/1981 Wheatley, Jr. ..... 323/314

4,319,180 3/1982 Nagano ..... 323/313

4,399,399 8/1983 Joseph ..... 323/315

*Primary Examiner*—Peter S. Wong

*Attorney, Agent, or Firm*—Wenderoth, Lind & Ponack

[57] ABSTRACT

An integrated precision reference source for supplying a reference voltage or a reference current under the condition of a lower feed voltage is disclosed, includes a first transistor, a first resistor connected between base and collector of the first transistor, a second resistor connected between base and emitter of the first transistor, and a second transistor whose base is connected to the collector of the first transistor and whose emitter is connected through a third resistor to the emitter of the first transistor.

3 Claims, 4 Drawing Figures

INTEGRATED PRECISION REFERENCE SOURCE

BACKGROUND OF THE INVENTION

1. Field of the Invention

The present invention relates to integrated voltage or current reference sources, and more particularly to precision reference sources capable of operating under the condition of lower feed voltage.

2. Description of the Prior Art

Conventionally, the Zener diode is widely used as a reference source. However, as is well known, Zener diodes have certain inherent breakdown voltage which undesirably restrict the capability of lower voltage use. On the other hand, a Bandgap reference has been developed. U.S. Pat. Nos. 3,617,859 and 3,887,863 disclose typical constructions of the Bandgap references. The Bandgap references also have certain inherent voltages caused by the extrapolated energy band-gap voltage of the semiconductor material at an absolute zero temperature (about 1.2 volts). Generally, this inherent voltage causes no problems, and therefore the Bandgap references are well used in any integrated circuits. However, the Bandgap references cannot work under the condition of feed voltage lower than 1.2 volts, and occupy a large chip area on an integrated circuit for keeping a high density ratio (about 10) of transistor current.

SUMMARY OF THE INVENTION

An object of the present invention is to provide a new precision reference source circuit which can operate certainly under the condition of a feed voltage lower than 1.2 volts.

Another object of the present invention is to provide an integrated precision reference source which can change the inherent voltage and temperature coefficient freely. The reference source or regulator of the present invention provides evident advantages over the conventional circuits, as preferred embodiments will be described hereinbelow together with the accompanying drawings.

DESCRIPTION OF THE PREFERRED EMBODIMENTS

Figure 1:
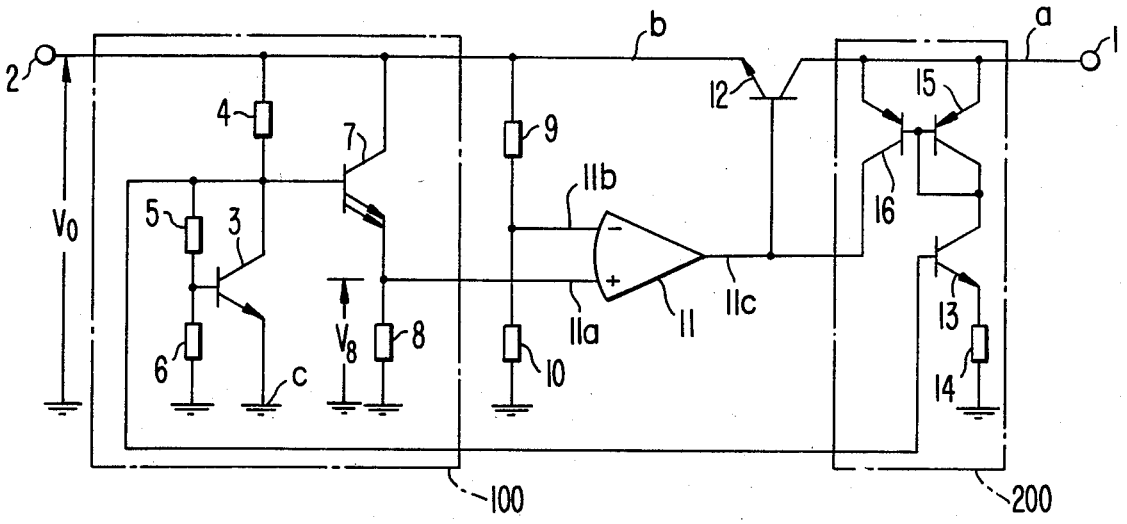
FIGS. 1, 2, 3 and 4 are circuit diagrams showing preferred embodiments of the present invention.

Referring now to FIG. 1 which shows a circuit diagram of a first embodiment of the present invention, a positive feed line (a) is connected to a positive supply voltage input terminal 1, an output feed line (b) is connected to an output terminal 2, and a negative feed line (c), shown by ground symbols, is connected to a negative supply voltage input terminal (not shown).

In a reference block 100, the emitter of a transistor 3 is connected to the negative feed line (c), the collector of the transistor 3 is connected through a resistor 4 to the output line (b), a resistor 5 is connected between the base and the collector of the transistor 3, and a resistor 6 is connected between the base and the emitter of the transistor 3. Also, the base of a transistor 7 is connected to the collector of the transistor 3; the emitter of the transistor 7 is connected through a resistor 8 to the negative feed line (c); the collector of the transistor 7 is connected to the output line (b). A pair of series connected resistors 9 and 10 are used as a voltage divider and are connected between the output line (b) and the negative feed line (c). The non-inverting input terminal 11*a* of a voltage comparator 11 is connected to the emitter of the transistor 7, and the inverting input terminal 11*b* of the voltage comparator 11 is connected to the voltage dividing point of the resistors 9 and 10. The base of an output control transistor 12 is connected to the output terminal 11*c* of the voltage comparator 11; the emitter of the output control transistor 12 is connected to the output line (b), and the collector of the output control transistor 12 is connected to the positive feed line (a).

In a bias block 200, the base of a transistor 13 is connected to the base of the transistor 7; the emitter of the transistor 13 is connected through a resistor 14 to the negative feed line (c), and the collector of the transistor 13 is connected to the base and collector of a transistor 15. The emitter of the transistor 15 is directly connected to the positive feed line (a). The base of a transistor 16 is connected to the base of the transistor 15; the emitter of the transistor 16 is directly connected to the positive feed line (a), and the collector of the transistor 16 is connected to the base of the output control transistor 12.

In FIG. 1, the reference block 100 operates as a reference voltage generator. The output voltage $V_0$ on the output terminal 2 is given by the following equation:

$$V_0 = V_8\left(1 + \frac{R_9}{R_{10}}\right) \tag{1}$$

where:

$V_8$=reference voltage across the resistor 8

$R_9$=resistance of the resistor 9

$R_{10}$=resistance of the resistor 10.

Also, the reference voltage $V_8$ is given as follows:

$$V_8 = \left(1 + \frac{R_5}{R_6}\right) \cdot V_{BE3} - V_{BE7} \tag{2}$$

$$V_{BE3} = \frac{k \cdot T}{q} \ln\left(\frac{I_3}{I_0 \cdot A_e}\right) \tag{3}$$

$$V_{BE7} = \frac{k \cdot T}{q} \ln\left(\frac{I_7}{I_0 \cdot A_e}\right) \tag{4}$$

where:

$R_5$=resistance of the resistor 5

$R_6$=resistance of the resistor 6

$V_{BE3}$=voltage drop across the base-to-emitter junction of the transistor 3

$V_{BE7}$=voltage drop across the base-to-emitter junction of the transistor 7 k=Boltzmann's constant ($=1.38\times10^{-23}$ joule/°K.)

q=charge of an electron ($=1.602\times10^{-19}$ coulomb)

T=absolute temperature of the base-to-emitter junction $I_3$=emitter current of the transistor 3

$I_7$=emitter current of the transistor 7

$A_e$=unit area of the emitter

N=multiple ratio of the emitter area $I_0$=reversed saturation current per unit area of the junction $I_0$ is given by following expression:

$$I_0 \approx \gamma \cdot T^3 \cdot \exp\left(-\frac{14000}{T}\right) \quad (5)$$

where $\gamma$ is a constant determined by semiconduction process.

The emitter current $I_7$ is given by the following expression:

$$I_7 = \frac{V_8}{R_8} \quad (6)$$

The emitter current $I_3$ is given by the following expression:

$$I_3 = \frac{\alpha \cdot V_8 - V_{BE3} \cdot \left(1 + \frac{R_5}{R_6}\right)}{R_4} - \frac{V_{BE3}}{R_6} \quad (7)$$

$$\alpha = 1 + \frac{R_9}{R_{10}} \quad (8)$$

where, $R_4$ is resistance of the resistor 4.

From equations (2), (3) and (4), $V_8$ can be expressed as:

$$V_8 = \frac{R_5}{R_6} \cdot \frac{k \cdot T}{q} \cdot \ln\left(\frac{I_3}{I_0 \cdot A_e}\right) + \frac{k \cdot T}{q} \cdot \ln\left(\frac{I_3 \cdot N}{I_7}\right) \quad (9)$$

By adding equation (6) to equation (9), $V_8$ can also be expressed as:

$$V_8 = \frac{R_5}{R_6} \cdot \frac{k \cdot T}{q} \cdot \ln\left(\frac{I_3}{I_0 \cdot A_e}\right) + \frac{k \cdot T}{q} \cdot \ln\left(\frac{I_3 \cdot R_8 \cdot N}{V_8}\right) \quad (10)$$

Also, from equations (3) and (7), $I_3$ can be expressed as:

$$I_3 = \frac{1}{R_4}\left\{\alpha \cdot V_8 - \left(1 + \frac{R_5}{R_6}\right) \cdot \frac{k \cdot T}{q} \cdot \ln\left(\frac{I_3}{I_0 \cdot A_e}\right)\right\} - \frac{k \cdot T}{R_6 \cdot q} \cdot \ln\left(\frac{I_3}{I_0 \cdot A_e}\right) \quad (11)$$

Equations (9) and (10) is expressed as transcendental equations, but the solutions of $I_3$ and $V_8$ can be easily obtained by numerical analysis with a computer.

Equation (9) qualitatively shows the characteristics of the present invention. The first term of equation (9) has negative temperature coefficient because of large temperature coefficient of $I_0$ shown in equation (5), and the second term of equation (9) has positive temperature coefficient. Therefore, the temperature coefficient and the value of the reference voltage $V_8$ can be selected freely by adjusting the values of $R_5$, $R_6$, $I_3$, $I_7$ and N. Also, under the condition of minimum value of N (i.e., N=1), a zero temperature coefficient of the reference voltage $V_8$ can be provided by reducing the resistance $R_5$ so as to be lower than the resistance $R_6$.

Moreover, an excellent regulator (or reference source) which can operate in the condition of lower feed voltage lower than 1.2 volts can be provided easily.

Figure 2:
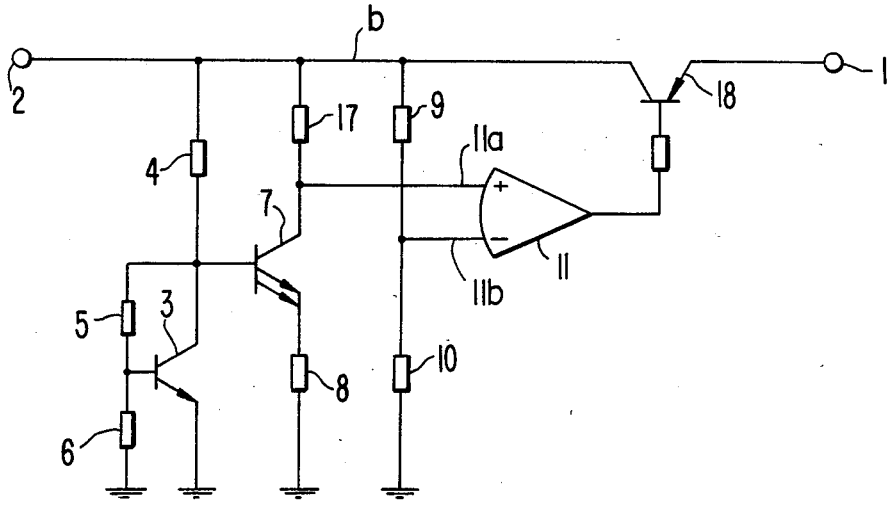

FIG. 2 shows a second embodiment of the present invention. In FIG. 2, the collector of the transistor 7 is connected through a resistor 17 to the output feed line (b), the noninverting input terminal 11*a* of the voltage comparator 11 is connected to the collector of the transistor 7, and an output control transistor 18 of reverse conductive type is employed instead of the output control transistor 12. The voltage regulator shown in FIG. 2 operates certainly in the condition of lower feed voltage compared with the prototype shown in FIG. 1.

Figure 3:
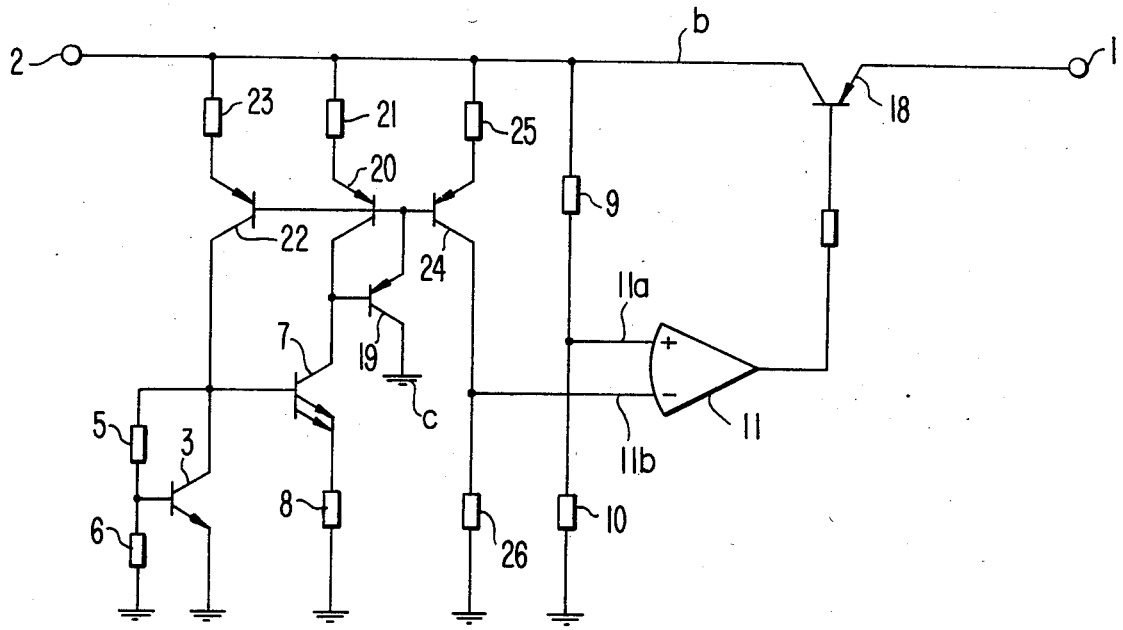

FIG. 3 shows a third embodiment of the present invention. The collector of the transistor 7 is connected to the base of a transistor 19 and the collector of a transistor 20, the emitter of the transistor 19 is connected to the base of the transistor 20, and the collector of the transistor 19 is connected to the negative feed line (c). The emitter of the transistor 20 is connected through a resistor 21 to the output feed line (b). The base of a transistor 22 is connected to the base of the transistor 20; the emitter of the transistor 22 is connected through a resistor 23 to the output feed line (b), and the collector of the transistor 22 is connected to the collector of the transistor 3. The base of a transistor 24 is connected to the base of the transistor 20; the emitter of the transistor 24 is connected through a resistor 25 to the output feed line (b), and the collector of the transistor 24 is connected through a resistor 26 to the negative feed line (c). The inverting input terminal 11*a* of the voltage comparator 11 is connected to the collector of the transistor 24. Here, a current-mirror circuit is constructed by the mutual connection of the transistors 19, 20, 22, 24 and the resistors 21, 23, 25, 26.

The circuit shown in FIG. 3 provides more excellent temperature characteristics as shown in equation (9), because the temperature coefficient of the emitter current $I_3$ will become nearly equal to the emitter current $I_7$. Actually, according to my experiments, the reference voltage of 130 mV and the temperature coefficient of 100 ppm can be obtained under the following conditions:

N=3, $R_5$=600 Ω, $R_6$=6 kΩ, $R_8$=1.3 kΩ, $R_{21}$=$R_{25}$=1 kΩ, $R_{23}$=200 Ω, and $R_{26}$=1.3 kΩ.

Although the voltage regulator shown in FIG. 3 has a voltage comparator, it is not always necessary.

Figure 4:
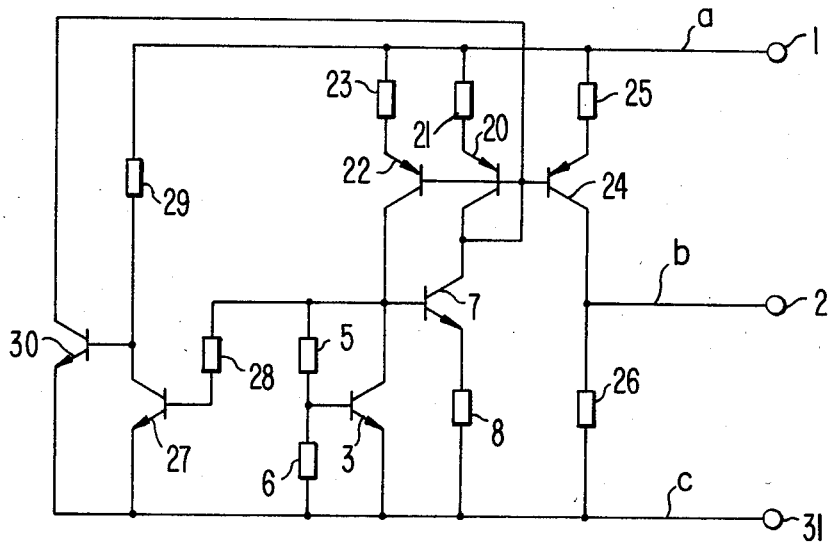

FIG. 4 shows a fourth embodiment of the present invention. The output terminal 2 is connected to the collector of the transistor 24. The base of a transistor 27 is connected through a resistor 28 to the collector of the transistor 3; the emitter of the transistor 27 is connected to the negative feed line (c), and the collector of the transistor 27 is connected through a resistor 29 to the positive feed line (a). The base of a transistor 30 is connected to the collector of the transistor 27; the emitter of transistor 30 is connected to the negative feed line (c), and the collector of the transistor 30 is connected to the base of the transistor 20. The negative feed line (c) is connected to a negative supply voltage input terminal 31.

Here, the transistors 27 and 30 are used as a starter for the reference circuit; that is, the transistor 30 turns to its off-state when the transistor 7 turns to its active-state. This starter can also effectively operate when it is used in the circuit shown in FIG. 3.

The embodiments as described above can be variously changed or modified without departing from the scope of the invention. Therefore, the scope of the invention should be understood from the appended claims.

I claim:

1. An integrated precision reference source comprising:

first and second feed lines;

a voltage output line;

a first transistor having a base, an emitter and a collector, said emitter of said first transistor being connected to said first feed line;

a first resistor connected between said base and said collector of said first transistor;

a second resistor connected between said base and said emitter of said first transistor;

a second transistor having a base, an emitter and a collector, said base of said second transistor being connected to said collector of said first transistor, and said collector of said second transistor being connected to said voltage output line, wherein the area of said emitter of said second transistor is larger than the area of said emitter of said first transistor;

a third resistor connected between said emitter of said second transistor and said emitter of said first transistor;

a fourth resistor connected between said collector of said first transistor and said voltage output line;

a voltage comparator having an output terminal, and first and second differential input terminals, said first differential input terminal of said voltage comparator being connected to said emitter of said second transistor;

fifth and sixth resistors for supplying a divided voltage which is proportional to an output voltage which appears on said voltage output line, said divided voltage being supplied to said second differential input terminal; and an output means connected between said second feed line and said voltage output line and coupled with said output terminal of said voltage comparator for supplying an output voltage proportional to an output current of said second transistor.

2. An integrated precision reference source comprising:

first and second feed lines;

a first transistor having a base, an emitter and a collector, said emitter of said first transistor being connected to said first feed line;

a first resistor connected between said base and said collector of said first transistor;

a second resistor connected between said base and said emitter of said first transistor;

a second transistor having a base, an emitter and a collector, said base of said second transistor being connected to said collector of said first transistor, wherein the area of said emitter of said second transistor is larger than the area of said emitter of said first transistor;

a third resistor connected between said emitter of said second transistor and said emitter of said first transistor;

a fourth resistor connected between said collector of said first transistor and said voltage output line;

a fifth resistor connected between said collector of said second transistor and said voltage output line;

a voltage comparator having an output terminal, and first and second differential input terminals, said first differential input terminal of said voltage comparator being connected to said collector of said second transistor;

sixth and seventh resistors for supplying a divided voltage which is proportional to an output voltage which appears on said voltage output line, said divided voltage being supplied to said second differential input terminal; and an output means connected between said second feed line and said voltage output line and coupled with said output terminal of said voltage comparator for supplying an output voltage proportional to an output current of said second transistor.

3. An integrated precision reference source comprising:

first and second feed lines;

a first transistor having a base, an emitter and a collector, said emitter of said first transistor being connected to said first feed line;

a first resistor connected between said base and said collector of said first transistor;

a second resistor connected between said base and said emitter of said first transistor;

a second transistor having a base, an emitter and a collector, said base of said second transistor being connected to said collector of said first transistor, wherein the area of said emitter of said second transistor is larger than the area of said emitter of said first transistor;

a third resistor connected between said emitter of said second transistor and said emitter of said first transistor;

a third transistor having a base, an emitter and a collector, said collector of said third transistor being connected to said collector of said second transistor, and said emitter of said third transistor being connected to said second feed line, for receiving an output current from said second transistor;

a fourth transistor having a base, an emitter and a collector, said base of said fourth transistor being connected to said base of said third transistor, said emitter of said fourth transistor being connected to said second feed line, and said collector of said fourth transistor being connected to said collector of said first transistor, for supplying an output current proportional to said output current of said second transistor which is supplied to said collector of said first transistor; and an output means for supplying one of either an output voltage or an output current which is proportional to said output current of said second transistor.

* * * * *